United States Patent [19]

Balsley et al.

[11] 4,013,054

[45] Mar. 22, 1977

[54] FUEL VAPOR DISPOSAL MEANS WITH CLOSED CONTROL OF AIR FUEL RATIO

[75] Inventors: Richard L. Balsley; Louis J. Faix, both of Washington, Mich.

[73] Assignee: General Motors Corporation, Detroit, Mich.

[22] Filed: Mar. 8, 1976

[21] Appl. No.: 664,541

Related U.S. Application Data

[63] Continuation-in-part of Ser. No. 575,344, May 7, 1975, abandoned.

[52] U.S. Cl. ..... 123/136; 123/127

[51] Int. Cl.[2] ..... F02M 59/00; F02M 13/06

[58] Field of Search ..... 123/136; 60/276, 285; 123/127

[56] References Cited

UNITED STATES PATENTS

| | | | |
|---|---|---|---|
| 3,154,060 | 10/1964 | Hunere | 60/276 |
| 3,752,134 | 8/1973 | Hollis | 123/136 |
| 3,872,848 | 3/1975 | King | 123/136 |

*Primary Examiner*—Ronald B. Cox
*Attorney, Agent, or Firm*—Robert M. Sigler

[57] ABSTRACT

In an engine fuel system including a carburetor, a liquid fuel tank and a fuel vapor reservoir for the storage of fuel evaporated from the liquid fuel tank, a conduit is provided between the fuel vapor reservoir and carburetor induction passage to supply fuel vapor from the fuel vapor reservoir to the engine for combustion during engine operation. The carburetor is set for an air-fuel ratio leaner than stoichiometric; and a valve is provided in the conduit to control the flow of fuel vapor therethrough in accordance with the output signal of a zirconia sensor in the engine exhaust in closed loop control to maintain a constant air-fuel ratio near stoichiometric. An air inlet is provided in the fuel vapor reservoir to ensure a continual rich mixture of fuel vapor and air therefrom during engine operation.

1 Claim, 1 Drawing Figure

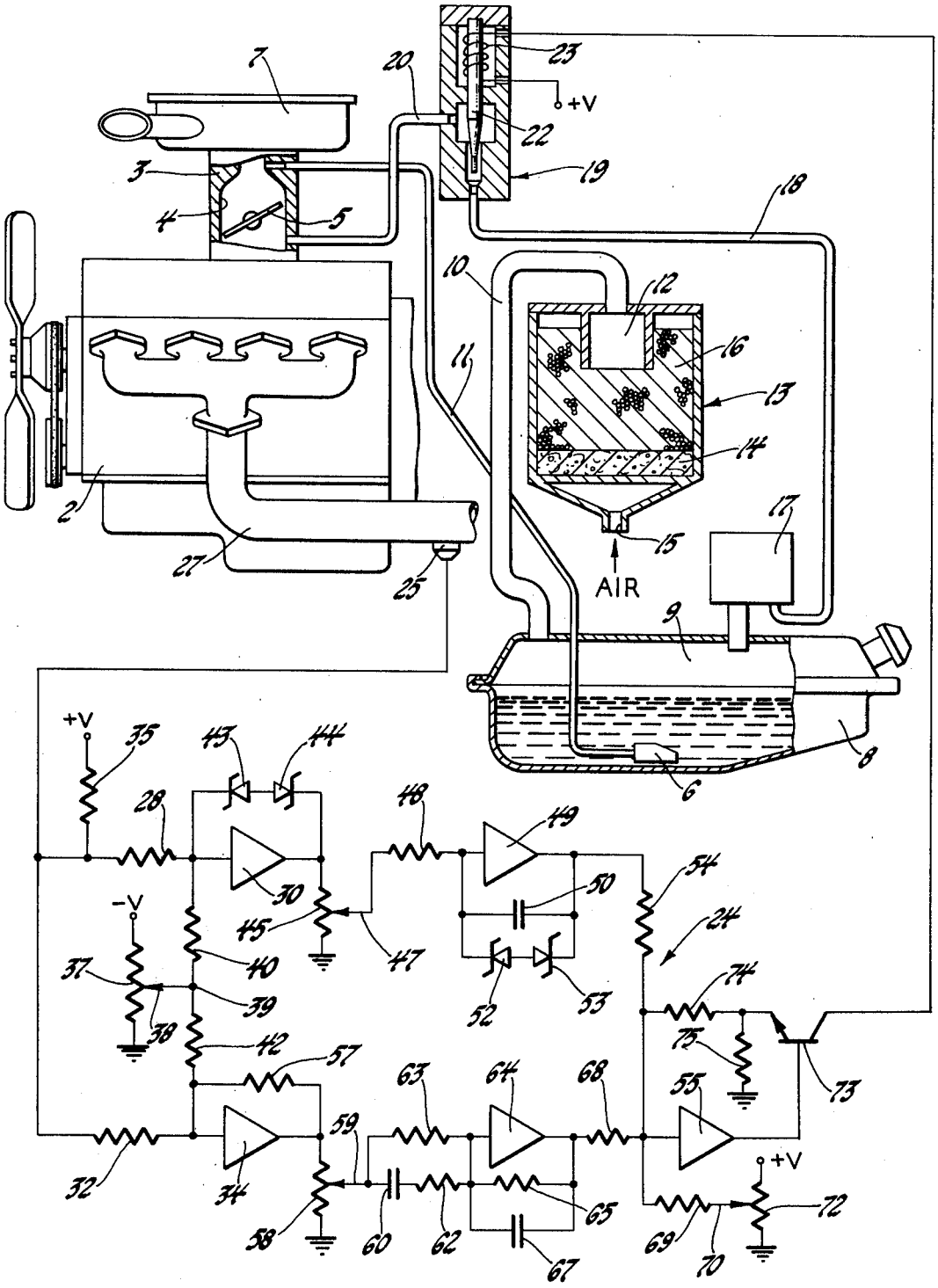
+V
AIR
-V
+V
+V

FUEL VAPOR DISPOSAL MEANS WITH CLOSED CONTROL OF AIR FUEL RATIO

SUMMARY OF THE INVENTION

This is a continuation-in-part of application Ser. No. 575,344, filed May 7, 1975 now abandoned. This invention relates to means for controlling the exhaust emission of combustion engines, including emission due to evaporation from fuel tanks and also due to the combustion process itself. In particular, this invention relates to means for disposing of fuel vapor evaporated from a fuel tank by providing it to the engine along with liquid fuel and air at a controlled constant overall air-fuel ratio for minimum emissions due to combustion.

In the development of means to control the loss of evaporated hydrocarbons from vehicle fuel tanks, the standard carbon canister, a container filled with activated charcoal or other adsorbing agents, has been found effective to store such evaporated hydrocarbons until they can be drawn into the carburetor induction passage during engine operation for combustion in the engine. Of course, there is a limit to the rate at which the engine can accept such evaporated hydrocarbons without upsetting the optimum air-fuel ratio and thus causing an increase in undesirable emissions from the combustion process; and a variety of means and methods have been used or suggested for limiting the induction of such fuel vapor under different engine operating conditions or mixing it with air before releasing it to the engine induction means. These means and methods have been adequate to meet the standards for which they were first designed.

There has been suggested, however, a method of controlling engine exhaust emissions wherein an engine with a catalytic converter is supplied with an air-fuel mixture at a substantially constant ratio near stoichiometric. The exhaust gases from the engine to the converter will thus contain unreacted air and fuel in approximately the same ratio for reaction in the converter. With precise control of the air-fuel mixture at the desired ratio, converter simultaneously oxidizes carbon monoxide and hydrocarbons and reduces oxides of nitrogen. Such precise control of air-fuel ratio suggests the use of a closed loop system with a standard zirconia sensor in the engine exhaust system to provide an air-fuel ratio feedback signal to air-fuel ratio control means in the engine fuel supply system. In such a system, disposal of fuel vapor from the fuel tank into the engine air induction passage results in a variable which might be too large under certain conditions for the closed loop control to compensate with the result that the emissions might increase over those expected from the closed loop system. However, fuel vaporized in the liquid fuel storage area must be disposed of; and the most practical method is combustion in the engine.

Therefore, this invention proposes to use the flow of fuel vapor from the carbon canister to the engine induction means as the means of controlling air-fuel ratio in a closed loop system. The carburetor is calibrated to produce an air-fuel ratio slightly leaner than the desired ratio; and a valve is provided for controlling the rate of flow of fuel vapor to the carburetor induction throat in accordance with the signal from the zirconia sensor. The addition of the fuel vapor and air from the carbon canister and fuel tank, which mixture is almost always richer than stoichiometric, to the slightly leaner than desired basic mixture of the carburetor, in an amount controlled by the closed loop system, provides an overall air-fuel mixture to the engine of the desired constant air-fuel ratio. In addition to disposing of the fuel vapor in a satisfactory manner, this invention also provides means for controlling air-fuel ratio precisely with minimum changes to the carburetor requiring extensive retooling and redesign. It can thus be added directly to existing automotive engines.

Further details and advantages of this invention will be apparent from the accompanying drawing and following description of the preferred embodiment.

DESCRIPTION OF THE PREFERRED EMBODIMENT

Referring to the FIGURE, an engine 2 is provided with a carburetor 3 having an induction passage 4 with a throttle 5. Carburetor 3 draws air from the atmosphere through an air cleaner 7 and is provided liquid fuel from a liquid fuel supply reservoir or fuel tank 8 by a fuel pump 6 and conduit 11. Carburetor 3 has conventional means, not shown, for mixing the air and fuel and is calibrated to produce a mixture somewhat leaner than stoichiometric.

Fuel tank 8 includes a volume 9 above the surface of the liquid fuel which contains air and evaporated hydrocarbons or fuel vapor and thus constitutes a fuel vapor space. Volume 9 communicates through a conduit 10 with one end 12 of a fuel vapor storage element or carbon canister 13, the other end of which includes an air filter 14 and an air inlet 15 and which is filled with a hydrocarbon adsorbing substance 16, which captures fuel vapor before it can escape to the atmosphere. Air inlet 15 can optionally be provided with a check valve, not shown, which allows the influx of air into canister 13 but further ensures that fuel vapor will not escape to the atmosphere. Volume 9 also communicates, through a liquid-vapor separating chamber 17, a conduit 18, an electromagnetic control valve 19 and a conduit 20, with induction passage 4 below throttle 5.

Electromagnetic control valve 19 includes a valve member 22 actuated by a coil 23 to control the flow of fuel vapor through valve 19 or prevent such flow. Coil 23 is supplied with an electric current from a control circuit 24, which is in turn responsive to the output signal of an air-fuel ratio sensor such as a standard zirconia sensor 25 as example of which is in the exhaust conduit 27 of engine 2. The zirconia sensor is a well known device which is sensitive to excess oxygen in the exhaust stream to produce a voltage output signal which exhibits a characteristic large change when the engine air fuel ratio passes through the region immediately surrounding stoichiometry.

Operating power for electric circuit 24 is provided from conventional power supply means providing current at voltages of +V and −V with reference to ground. Ground in this case is seen to be the potential of the vehicle body on which engine 2 is mounted. It would be within the skill of one skilled in the art to redesign circuit 24, if desired, with ground in place of −V and an intermediate voltage of +½V in place of ground. In any case, circuit 24 is shown only as an example of suitable signal processing means and its precise elements and bias voltages are subject to alteration within the scope of the invention.

In circuit 24, the output of sensor 25 is connected through a resistor 28 to the input of an operational amplifier 30 and through a resistor 32 to the input of an operational amplifier 34, which is also connected through a resistor 35 to potential +V. A resistor 37 is connected between ground and potential −V; and a variable tap 38 on resistor 37 is connected to the junction 39 between a pair of resistors 40 and 42 connected in series between the inputs to operational amplifiers 30 and 34.

The output of operational amplifier 30 is connected through back-to-back connected zener diodes 43 and 44 to the input of operational amplifier 30 and through a resistor 45 to ground. Variable tap 47 of resistor 45 is connected through a resistor 48 to the input of an operational amplifier 49, the output of which is connected through a capacitor 50 and, in parallel, through a pair of back-to-back zener diodes 52 and 53 to the input of operational amplifier 49 and is also connected through a resistor 54 to the input of an operational amplifier 55.

The output of operational amplifier 34 is fed back through a resistor 57 to the input thereof and further connected through a resistor 58 to ground. Variable tap 59 of resistor 58 is connected through a capacitor 60 and resistor 62 in series and, in parallel, through a resistor 63 to the input of an operational amplifier 64. The output of operational amplifier 64 is fed back through a resistor 65 and parallel capacitor 67 to the input thereof and connected through a resistor 68 to the input of operational amplifier 55.

The input of operational amplifier 55 is also connected through a resistor 69 to the variable tap 70 of a resistor 72 connected between potential +V and ground. The output of operational amplifier 55 is connected to the base of a power transistor 73, the emitter of which is connected through a resistor 75 to ground. The collector of transistor 73 is connected through coil 23 of valve 19 to potential +V.

In operation, when sensor 25 reaches its operating temperature, it generates an output signal which is low at lean air-fuel ratios, high at rich air-fuel ratios and undergoes a steep transition between the high and low levels in the vicinity of stoichiometry. This signal is applied through resistor 28 to operational amplifier 30 and through resistor 32 to operational amplifier 34.

Back-to-back zener diodes 43 and 44 combine with operational amplifier 30 to form a comparator which compares the input from resistor 28 to a constant reference voltage obtained from voltage source −V through resistors 37 and 40. The output of operational amplifier 30 is thus a square wave which assumes one of two voltage levels depending on which of the signal or reference input voltage is greater. The effect of this is to square the output signal characteristic of sensor 25 for application through resistor 48 to an integrator comprising operational amplifier 49, capacitor 50 and back-to-back zener diodes 52 and 53. Integrator 49 is thus affected only by the amount of time that the air-fuel ratio in exhaust conduit 27 spends above and below the desired level and is not affected by asymmetrical characteristics above and below the desired level due to changing temperature and sensor age. The output of integrator 49 is fed through resistor 54 to a summing amplifier 55.

Operational amplifier 34 amplifies the sum of the output signal from sensor 25 through resistor 32 and a reference from voltage source −V through resistors 37 and 42. The amplified signal from resistor 58 is applied proportionally through resistor 63 and with phase lead through capacitor 60 and resistor 62 to amplifier 64 to provide phase lead for anticipation of air-fuel ratio changes. The output of amplifier 64 is applied through resistor 68 to the summing amplifier 55, along with a reference voltage from potential +V through resistors 69 and 72.

Summing amplifier 55 forms a current generator with transistor 73, the small resistor 75 to ground and the feedback resistor 74. The output of the current generator, obtained from the collector of transistor 73, is a regulated current, the level of which contains the signal information, controlled by the voltage output of amplifier 55. This current is applied to coil 23 of valve 19 and positions element 22 accordingly. Of course, there are many other circuits well known to those skilled in the art of closed loop control which could be substituted for circuit 24 and be operable in this invention.

Valve member 22 controls the flow of fuel vapor through conduits 18 and 20 to induction passage 4, to which the vapor is drawn by induction vacuum during the operation of the engine 2. The fuel vapor is obtained from carbon canister 13, which has the capacity to store a large amount of fuel vapor from fuel tank 8 during inactivity of engine 2, and from continuous evaporation of fuel in tank 8 during engine operation. The admission of air through opening 15 in carbon canister 13 helps flush vapor from carbon canister 13 upon the initiation of engine operation and assists the evaporation of the fuel vapor in tank 8 and the transportation thereof to induction passage 4 during certain engine operating conditions.

Tests on a vehicle equipped with an engine and fuel system modified according to this invention have shown that sufficient fuel vapor is available from the carbon canister 13 and fuel tank 8 to operate the closed loop control under normal engine operating conditions, even with a cold fuel tank. The output signal of sensor 25, as modified in circuit 24, continuously varies the position of valve member 22 to vary the admission of the rich fuel vapor or fuel vapor-air mixture through conduit 20 to the consistently leaner than desired mixture from carburetor 3 in sense to produce a substantially constant overall air-fuel ratio for engine 2 as sensed by sensor 25.

If engine operating conditions are encountered which result in insufficient fuel vapor from carbon canister 13 and tank 8 to maintain closed loop control, the failure will necessarily be in the direction of a lean air-fuel ratio. Since the air-fuel ratio supplied by carburetor 3 is not expected to be more than a few tenths of an air-fuel ratio unit leaner than stoichiometric, the engine will operate smoothly at the leaner ratio with low emissions of carbon monoxide and hydrocarbons. The engine will have warmed up sufficiently to operate smoothly with the leaner mixture, since some time will have had to elapse since the engine was started, in which time the fuel vapor stored in carbon canister 13 is exhausted, before these engine operating conditions will occur.

Since, in this embodiment, sensor 25 is a zirconia sensor, which exhibits a high resistance and low output when colder than a minimum operating temperature, resistor 35 in circuit 24 is used to supply a high voltage input to circuit 24 when sensor 25 is cold. This is, in essence, an artificial rich signal which will cause valve 19 to stop the flow of fuel through conduit 20 or reduce it to a specified low rate during the period of sensor warm up. During this time, air-fuel ratio can be controlled in an open loop manner by standard means such as a carburetor choke. When sensor 25 warms up from exhaust gases sufficiently to generate a dependable output signal, its internal resistance will fall and the effect of resistor 35 in circuit 24 will be reduced to a negligible level.

Alternatively, during engine and sensor warm up, resistor 35 can be eliminated to provide a signal in the opposite direction, which will cause valve 19 to open to a position effective to enrich the engine air-fuel ratio until sensor 25 warms up sufficiently to take control. In this case, the use of the already vaporized fuel from canister 13 and tank 8 should improve the cold operating characteristics of engine 2, with carbon monoxide and hydrocarbons being oxidized in the catalytic converter.

It will be noted that the apparatus and method of this invention is capable of maintaining closed loop control even during engine idle and conditions of low manifold vacuum as in acceleration. Systems attempting to control air-fuel ratio through the main carburetor metering jets using vacuum powered motor means, which systems are more typical of closed loop systems generally suggested, fail to control in these modes of engine operation.

It should also be noted that, although the apparatus and method is illustrated in the embodiment of a carbureted engine fuel system, and has some special advantages with such a system, it is not limited solely to carbureted engines but may also be used with alternative fuel supply systems such as mechanical or electronic fuel injection systems. The induction passage 4 of such a system would be the air induction passage.

The described embodiment of my invention is not the only embodiment that will occur to those skilled in the art. Therefore the invention should be limited only by the claim which follows.

We claim:

1. In combination with an internal combustion engine having an air-fuel induction passage and an exhaust passage and wherein the combustion products in the exhaust passage are determined in part by the air-fuel ratio in the induction passage:

means comprising a liquid fuel supply reservoir and a fuel vapor space in communication therewith, said fuel vapor space including a fuel vapor storage element effective to store fuel vapor evaporating from the liquid fuel supply reservoir and thus prevent its escape to the atmosphere and means communicating the fuel vapor storage element to the atmosphere when the pressure in the fuel vapor storage element falls below atmospheric to allow the influx of atmospheric air through the fuel vapor storage element to flush stored fuel vapor therefrom into said fuel vapor space;

a carburetor effective to meter predetermined amounts of liquid fuel from the reservoir to the induction passage to form the air-fuel mixture therein;

a sensor in the exhaust passage responsive to the constituents therein and effective to generate a signal therefrom indicative of the air-fuel ratio in the induction passage relative to a predetermined air-fuel ratio; and means responsive to the sensor effective to communicate the fuel vapor space to the lower than atmospheric pressure of the induction passage and flow fuel vapor from the fuel vapor space and fuel vapor storage element to the induction passage to augment the liquid fuel supplied to the air-fuel mixture, said last means modulating the amount of flow in sense to increase the fuel content in the air-fuel mixture when the sensor indicates an air-fuel ratio leaner than the predetermined air-fuel ratio and to decrease the fuel content in the air-fuel mixture when the sensor indicates an air-fuel ratio richer than the predetermined air-fuel ratio, whereby the engine tends to operate at the predetermined air-fuel ratio and the vapor stored in said fuel vapor storage element is supplied to the engine for combustion without upsetting the predetermined air-fuel ratio.

* * * * *